US005233902A

United States Patent [19]

Bernardes

[11] Patent Number: 5,233,902

[45] Date of Patent: Aug. 10, 1993

[54] SLIDING BREECH BLOCK SYSTEM FOR REPETITIVE ELECTRONIC IGNITION

[75] Inventor: Jack S. Bernardes, Fredericksburg, Va.

[73] Assignee: The United States of America as represented by the Secretary of the Navy, Washington, D.C.

[21] Appl. No.: 880,852

[22] Filed: May 11, 1992

[51] Int. Cl.[5] ..... F41B 6/00

[52] U.S. Cl. ..... 89/8; 102/472; 174/107; 174/113 R; 89/24

[58] Field of Search ..... 89/8; 102/472; 124/3; 174/107, 113 R

[56] References Cited

U.S. PATENT DOCUMENTS

| | | | |
|---|---|---|---|
| 317,409 | 5/1885 | Monfort | 102/472 |
| 1,314,761 | 9/1919 | Smith | 89/135 |
| 3,251,216 | 5/1966 | Broske | 102/202.9 |
| 3,537,353 | 1/1970 | Nelson | 89/135 |
| 3,650,174 | 3/1972 | Nelson | 89/28 |
| 3,748,770 | 7/1973 | Mitchell | 42/84 |
| 3,967,530 | 7/1976 | Vorgrimler et al. | 89/135 |
| 4,486,623 | 12/1984 | Ploppa | 174/113 R |
| 4,563,828 | 1/1986 | Kriegeskorte | 42/84 |
| 4,653,211 | 3/1987 | Brede et al. | 42/84 |
| 4,777,864 | 10/1988 | Siech et al. | 89/45 |
| 4,881,463 | 11/1989 | Ninio et al. | 102/202.2 |
| 4,960,033 | 10/1990 | Quantz | 89/28.05 |
| 4,982,649 | 1/1991 | Koine | 89/28.05 |
| 5,072,647 | 12/1991 | Goldstein et al. | 89/8 |

FOREIGN PATENT DOCUMENTS

| | | | |
|---|---|---|---|
| 60252 | 10/1942 | Denmark | 174/107 |
| 2551473 | 5/1977 | Fed. Rep. of Germany | 102/472 |
| 80422 | 3/1963 | France | 174/107 |
| 5025 | of 1887 | United Kingdom | 174/113 R |
| 517732 | 2/1940 | United Kingdom | 102/472 |
| 1444987 | 8/1976 | United Kingdom | 174/107 |

OTHER PUBLICATIONS

Materials in Design Engineering, Mid-October 1965, vol. 62, No. 5, pp. 148-149.

*Primary Examiner*—Stephen G. Bentley
*Attorney, Agent, or Firm*—John D. Lewis; Jacob Shuster

[57] ABSTRACT

A sliding breech block system and method for repetitive firing of electrothermal cartridges in an electrothermal gun are provided. The sliding breech block system comprises a high-power, low resistance, flexible coaxial cable which is routed through a sliding breech-block, a pulse-forming network, and two groups of bristles for conducting the pulses from the breech block to the electrothermal cartridge. The power cable comprises two layers of individually insulated, multi-strand wires both within a jacket of braided wire. The method for repetitively igniting an electrothermal gun comprises the steps of fixedly attaching tightly-packed, brass bristles to the electrothermal cartridge conductors, sliding the breech-block into position so that its surface contacts the brass bristles of the cartridge, and supplying an electrical current from the pulse-forming network to the cartridge by means of a flexible high-power cable.

2 Claims, 5 Drawing Sheets

SLIDING BREECH BLOCK SYSTEM FOR REPETITIVE ELECTRONIC IGNITION

ORIGIN OF THE INVENTION

The invention described herein was made in the performance of official duties by an employee of the Department of the Navy and may be manufactured, used, licensed by or for the Government for any governmental purpose without payment of any royalties thereon.

FIELD OF THE INVENTION

The present invention relates generally to the ignition of ammunition and more specifically to an apparatus and method for repetitive ignition of electrothermal cartridges.

DESCRIPTION OF RELATED ART

Conventional firearms use a mechanical striker system which operates by having a hammer and a firing pin coact with the pull of a trigger. When the trigger is pulled, the firing pin moves and strikes a percussion primer, which in turn ignites the ammunition. This type of firing mechanism inherently has a time lag between the pull of the trigger and the ignition of the ammunition caused by the mechanical inertia of the hammer and the firing pin. This delay typically varies between several milliseconds and tens of milliseconds. Normal wear of the mechanical firing system also deteriorates performance.

An alternative to the mechanical system is an electronic ignition system for an electrically operated primer. For example, the prior art in U.S. Pat. No. 3,650,174 by Nelson discloses an electronic ignition system which comprises a trigger for converting mechanical movement to electrical signals without the need of electrical contacts. This system includes electrically conductive firing pins which meet electrical contacts located on the head of the electrically-primed cartridge. Passage of an electrical current through the firing pin and the electrical contacts to the cartridge ignites a priming compound within the cartridge.

The prior art in U.S. Pat. No. 3,748,770 by Mitchell, on the other hand, discloses an electrical ignition system for firing of caseless ammunition in a gun that utilizes two fixed electrical contacts in the bolt face of a gun. The two fixed electrical contacts serve as a conductive path for a high-voltage induced current from a power supply to a primer disk having two portions of electrically conductive material. An electrical primer having an electrically conductive priming mixture connects to the primer disk and ignites upon transfer of the induced current.

These prior art devices are presently limited to operation in only the single-shot mode. This limitation occurs because the electrical leads that provide the high-power electrical connections necessary to fire an electrothermal gun must be bolted onto the gun. This bolt-on connection prevents any repetitive firing of several cycles per second because the electrical connections must be broken and reconnected between each firing to allow for extraction of the spent cartridge case and reloading of a new cartridge. The limitation also exists because the electrical leads are fixed and thereby do not accommodate the motion of a sliding breech block and the recoil of the gun. The prior art also is incapable of providing a high-pressure electrical contact between two sliding surfaces.

Electrothermal (ET) guns are similar to conventional guns in design and operation. Like a conventional gun, the projectile is propelled by generating high pressure inside a barrel, behind the projectile. The high pressure is produced by rapidly heating the medium behind the projectile. ET guns differ from conventional guns in the method used to generate heat inside the barrel. Whereas, in conventional guns heat is generated by burning a chemical propellant, in ET guns electrical energy is converted to thermal energy (heat) inside the barrel—therefore the name electrothermal. The electrical-to-thermal energy conversion occurs in a plasma generator which serves as the electrical load resistor for an external electrical power source, normally a high-energy, pulse-forming network.

Unlike conventional guns, a substantial electrical power pulse (on the order of a gigawatt and with a duration of several milliseconds) must be delivered to the back of the ET cartridge. This requires a nontrivial electrical connection to the gun. Heretofore this has been achieved with bolt-on type connections which limits the gun in operation to a single-shot mode.

For repetitive gun operation an autoloading mechanism must be used, which in turn dictates the implementation of a high-voltage, high-current, make-break contact in the breech area of the gun.

This addresses the electrical contact problem of repetitively transferring (at a high rate) a high-power (high-voltage and high-current) electrical pulse to an electrical load which requires that the electrical contacts to the load be broken between pulses. A rapid-fire electrothermal gun is an example of a system that has this electrical requirement.

SUMMARY OF THE INVENTION

An object of the present invention is to provide high-speed repetitive firing of an electrothermal gun.

Another object of the present invention is to provide electrical leads capable of sending a high-power, high-current, and high-voltage pulse.

A further object of the present invention is to provide electrical leads that are flexible and can accommodate the motion of a sliding breech block and the recoil of the gun.

Yet another object of the present invention is to provide a high-pressure electrical contact between two sliding surfaces.

The present invention attains the foregoing and additional objects by providing an apparatus and a method for repetitive ignition of electrothermal cartridges. The apparatus comprises a sliding breech block, a flexible, coaxial, high-voltage, high-current, high-power cable, two groups of bristles and a pulse-forming network. The breech block has a channel for receiving the high-power cable. The high-power cable has an inner layer and an outer layer of multi-strand wire, with each layer having a distal end and a proximal end. The distal ends of both layers of multi-strand wire connect to the pulse-forming network. The proximal end of the inner layer of multi-strand wire attaches electrically to a refractory-metal contact. The proximal end of the outer layer of multi-strand wire connects electrically to the sliding breech block. The high-power cable further comprises a jacket of braided wire which is electrically connected to the outer layer at both the distal and proximal ends. The jacket encircles the outer layer and contains the electromagnetic fields induced in the high-power cable. Preferably, flexible vinyl tubing electrically insulates the inner layer of wire, and fiberglass tape wound in a helical pattern over the braided jacket mechanically contains the outer layer of multi-strand wire. The two groups of bristles are tightly-packed and attached to the ignitable end of the electrothermal cartridge at one end. The outer end of the bristles protrudes from the surface of the ignitable end of the cartridge and is placed such that it will contact the sliding breech block. Preferably, both groups of bristles are made of brass.

The process of the present invention comprises fixedly attaching two tightly-packed groups of bristles to the ignitable end of each electrothermal cartridge, supplying an electric pulse, and positioning a sliding breech block such that the breech block contacts both groups of bristles and transmits the electric pulse for energizing the electrothermal cartridge.

DETAILED DESCRIPTION OF THE INVENTION

Figure 1:
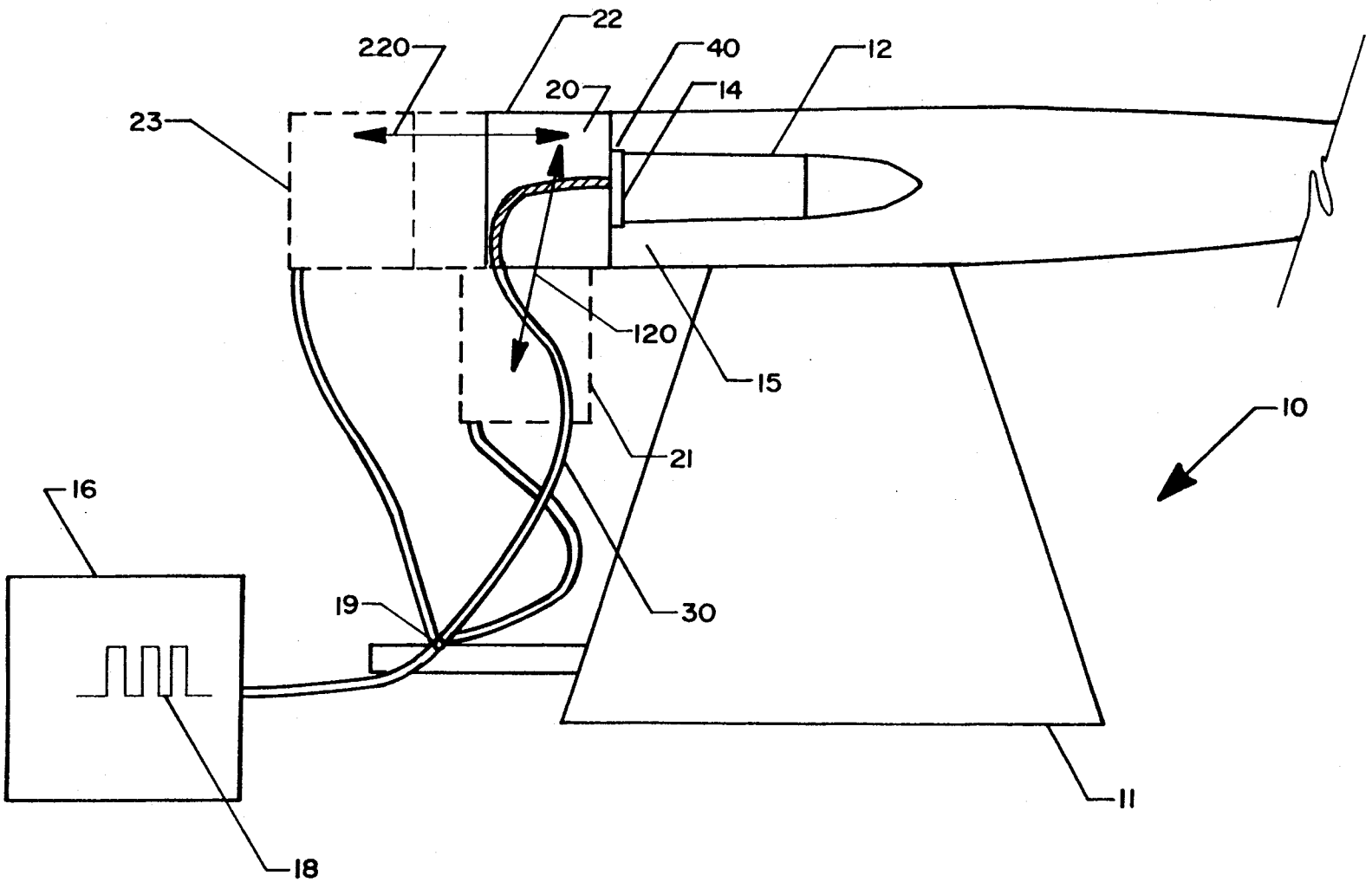
FIG. 1 illustrates a side view of an electrothermal gun having an electronic ignition system of the present invention.

The present invention involves the basic operation depicted in FIG. 1, simplifying for illustrative purposes, a side view of an electrothermal gun 10. The gun has four major components which provide for repetitive ignition of an electrothermal cartridge 12 having an ignitable end 14. These components include a pulse-forming network 16 providing electrical pulses 18, a sliding breech block 20, a flexible high-power cable 30, and a means for conducting 40, which conducts the electrical pulses 18 from the pulse-forming network 16 to the ignitable end 14 of the cartridge.

As represented in FIG. 1, the sliding breech block 20 moves between basically three positions during the ignition cycle. The ignition cycle begins with the breech block in its starting position 21, which allows for extraction of a spent cartridge case from barrel 15 of the gun and the reloading of a new electrothermal cartridge for firing. The breech block 20 then slides up along a path that is nearly normal to the axis of the barrel 15, as shown generally by arrows 120, into firing position 22. Location of the breech block at the firing position 22 provides mechanical support to the back of the cartridge 12 in addition to igniting the cartridge. After ignition of the cartridge, the breech block moves along the axis of barrel into recoil position 23, as shown generally by direction arrows 220. The sliding breech block next returns to position 22 along direction 220 after the forces from discharge of the cartridge dissipate and then to position 21 along direction 120 so as to begin another loading and firing cycle.

The pulse-forming network (PFN) 16 produces long duration, high-voltage, high-current electrical pulses 18 of several hundred kiloamps over several milliseconds. The pulses are provided at a highly repetitive rate of several cycles per second, which allows for fast repetitive ignition of electrothermal cartridges.

The flexible, high-power cable 30 electrically connects at one end to the PFN 16 and at the other end to the sliding breech block 20 and thereby sends the pulses 18 from the PFN to the sliding breech block. Flexibility for cable 30 is required to accommodate both the vertical and the horizontal motion of the sliding breech block along its starting, firing and recoiling positions. The cable 30 also attaches at a fixed point 19 of electrothermal gun mount 11 with sufficient slack in the section of the cable between point 19 and the breech block 20 to accommodate the rapid motion of the breech block. FIG. 1 shows the positions of cable 30 as it moves with breech block 20.

Figure 2:
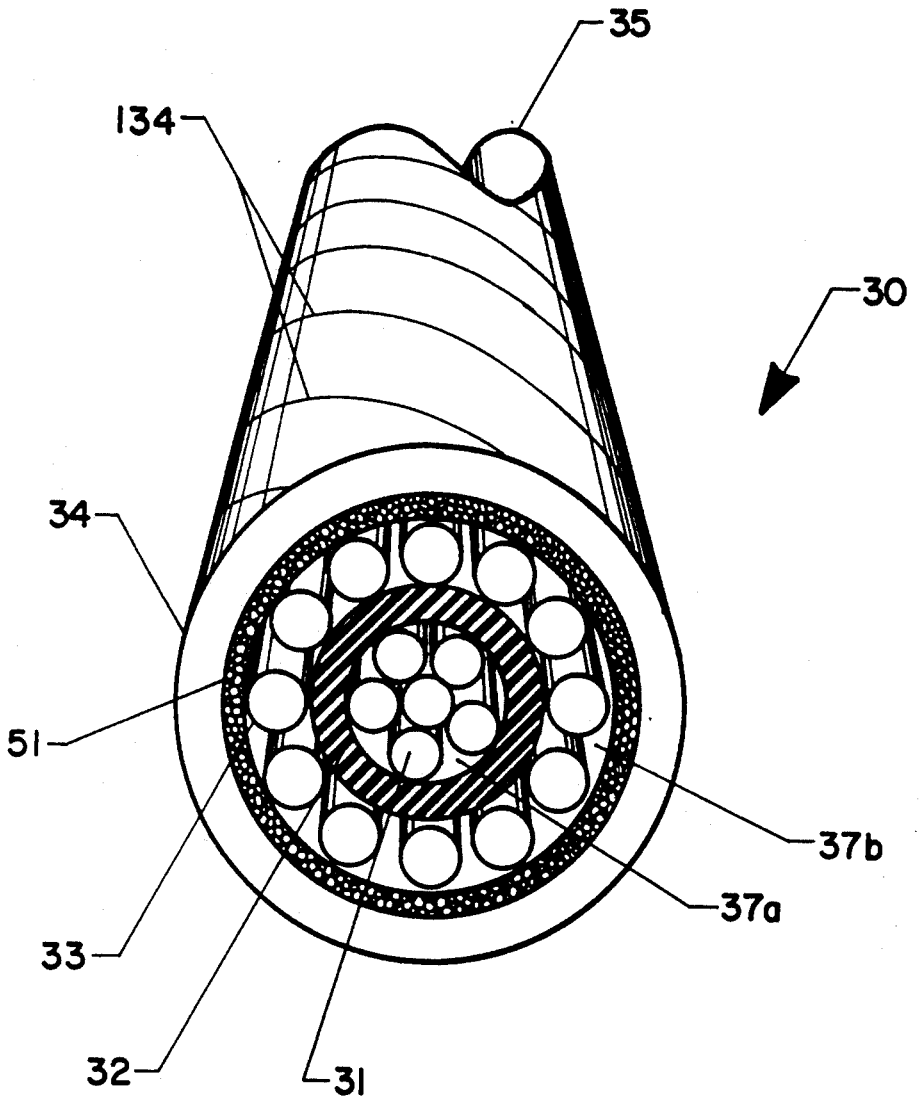
FIG. 2 is a perspective view of a high-power cable of the present invention.

FIG. 2 gives a perspective view of high-power cable 30. The cable has a distal end 35 which connects electrically to the PFN 16. The cable comprises an inner layer 31 and an outer layer 33 of bundles of multi-strand wire, and each layer respectively has a proximal end 37*a* and 37*b*. Preferably, the inner layer 31 and the outer layer 33 are concentric to each other.

Each bundle of the stranded wire is individually insulated. This individual insulation between wire bundles reduces the skin-depth effects of the current created by the pulse 18 by forcing the current to flow through the bulk of the conductors and thereby reducing the resistance of the cable. Multi-strand wire also adds to the flexibility of cable 30.

The cable 30 further comprises a jacket of braided wire 51 which is electrically connected at each of its ends to the outer layer 33 of multi-strand wire. The jacket of braided wire 51 encircles the outer layer of multi-strand wire and contains any transient electromagnetic fields induced in the cable during transmission of the electrical pulse 18. Electromagnetic field containment is required to avoid electromagnetic pulse interference to other electronics when the high energy pulse is transmitted.

Located between the inner layer 31 and outer layer 33 is a middle layer 32 of flexible vinyl tubing. The middle layer 32 encircles the inner layer 31 and electrically insulates the high voltage in the inner layer of wires from the outer layer. The vinyl tubing also adds to the overall flexibility of the cable.

FIG. 2 illustrates that layers of fiberglass tape 34 wind in a helical fashion 134 around the braided wire 51. The tape 34 provides mechanical containment by restraining the outer layer 33, which is repelled by electromagnetic forces induced from the current flowing through the inner layer of multi-strand wires. The tape 34 also strengthens the cable 30 during its flexing to accommodate the motion of the sliding breech block.

Figure 3:
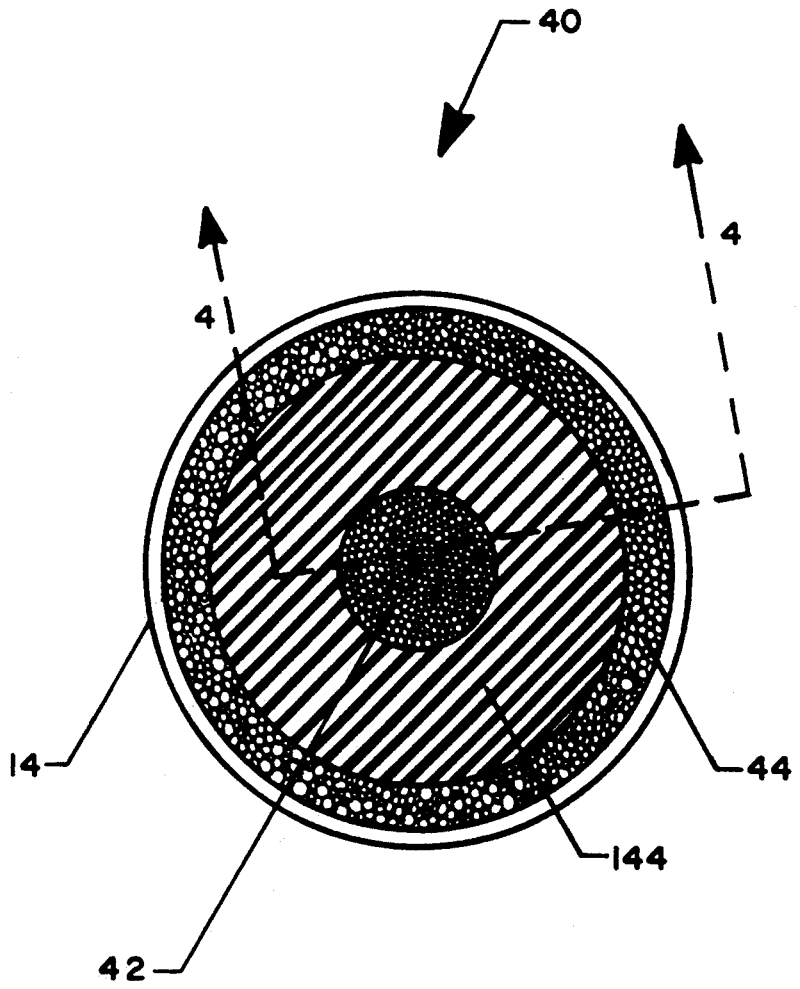
FIG. 3 is a front view of the ignitable end of an electrothermal cartridge.

FIG. 3 gives a view of the ignitable end of the electrothermal cartridge and the means for conducting 40. The means for conducting 40 comprises two groups of tightly-packed bristles, an inner group 42 and an outer group 44. Located between the two groups of bristles is a cartridge electrical insulator 144. The outer group of bristles 44 forms a ring around the cartridge insulator 144.

Figure 4:
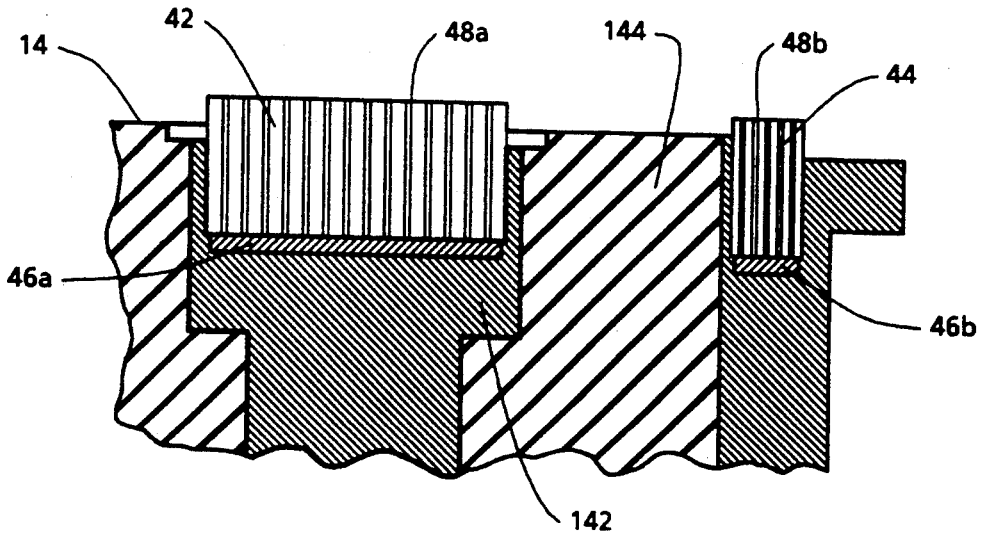
FIG. 4 is a partial cross-sectional view of two groups of bristles along the section line 4—4 of FIG. 3.

FIG. 4 is a partial cross-sectional view of the two groups of bristles along partial section line 4—4 of FIG. 3. Each group of bristles has two ends. The inner group of bristles 42 has its first end 46*a* soldered to the high-voltage center pin 142 located at the ignitable end 14 of the electrothermal cartridge. Likewise, the outer group of bristles 44 has its first end 46*b* soldered to the perimeter of the ignitable end 14. Second ends 48*a* and 48*b* of the two groups of bristles 42 and 44 respectively protrude from cartridge insulator 144 of the ignitable end 14 of the cartridge and thereby are positioned for contact with the sliding breech block. Preferably, both the inner group 42 and the outer group 44 of bristles are made of brass.

Figure 5:
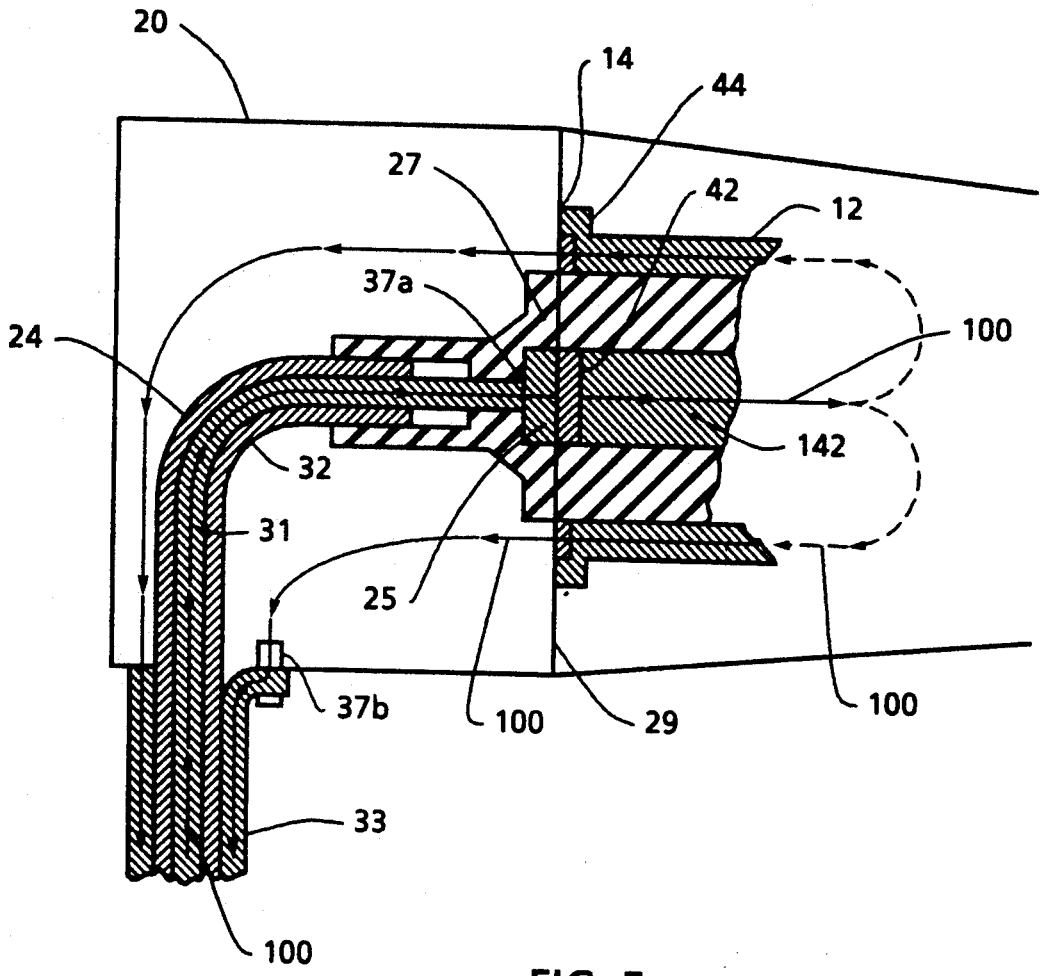
FIG. 5 depicts a cross-sectional view of the present invention when a sliding breech block is in the firing position.

FIG. 5 depicts a cross-sectional view of the present invention when the sliding breech block 20 is at the firing position. The breech block 20 has a channel 24, and the inner layer 31 and the middle layer 32 of the cable are routed through this channel. The breech block 20 further comprises a refractory contact 25, with the proximal end 37*a* of the inner layer of multi-strand wire being electrically connected to the refractory contact 25. The middle layer 32 extends into a second insulator 27. This second insulator 27 combines with the middle layer of vinyl tubing to insulate the inner layer of wires, which rise to high-voltage during current conduction from the breech block, which is at ground potential.

Figure 6:
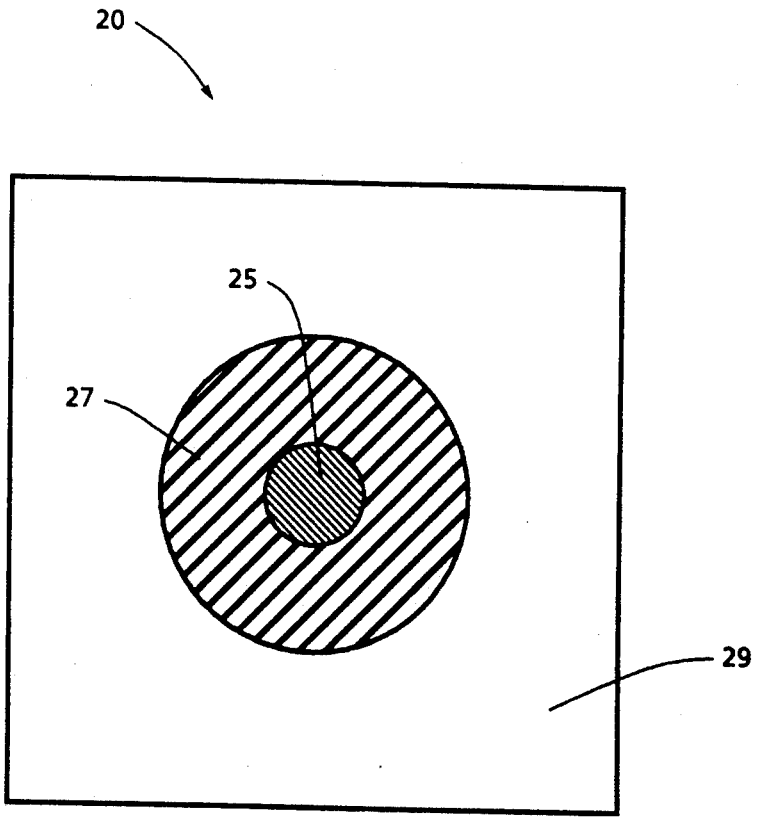
FIG. 6 is a front view of the sliding breech block on the surface which contacts the ignitable end of the electrothermal cartridge.

FIG. 6 gives a front view of the breech block 20 on the surface which contacts the ignitable end of the electrothermal cartridge. Preferably, the refractory contact 25 has a cross-sectional, circular surface area that matches the cross-sectional surface area of the inner group 42 of packed bristles shown in FIG. 3. The second insulator 27 has a cross-sectional surface area that matches the cross-sectional surface area of the cartridge insulator 144 shown in FIG. 3. Area 29 serves as an outer surface to contact with the cross-sectional surface area of the outer group of bristles 44 as shown in FIG. 3.

Referring back to FIG. 5, the proximal end 37*b* of the outer layer 33 is electrically connected to the breech block 20 on a surface other than the surface which contacts the ignitable end of the cartridge. This connection completes the circuit which transmits the electrical pulse for ignition. This circuit is indicated by a series of arrows 100. The pulse begins at the pulse-forming network 16 and travels through the inner layer 31 of multi-strand wires to the refractory contact 25. The pulse is next conducted through the contact 25 to the inner group of bristles 42 and then to the high-voltage center pin 142 and through the electrothermal cartridge 12. The cartridge behaves electrically like a variable resistor, with the pulse exiting the cartridge 12 through the outer group of bristles 44, traveling through the breech block to the outer layer 33 of multi-strand wires and then returning to the pulse-forming network.

Ignition of an electrothermal cartridge requires conduction of current with high magnitude, generally hundreds of kiloamps, for a duration of several milliseconds. Given this high current, the contact surfaces between the sliding breech block and the ignitable end of the cartridge must provide a uniform pressure of contact between the two near parallel sliding surfaces. The tightly-packed group of bristles gives a compressible and resilient contact material and thereby achieves this pressurized contact. As a result, electrothermal ignition of the cartridges by the present invention occurs at speeds of high repetition.

The unique features of this invention include the use of a sliding breech block for a loading system of electrothermal guns, the use of a compressible contact material for pressurized, high-power electrical contacts between two near-parallel sliding surfaces, and the use of a flexible, high-power, low electrical resistance cable capable of accommodating the motion of the breech block and of transmitting a high-voltage, high-current electrical pulse. Also, modification of conventional guns having an autoloader with a sliding breech block would permit the features of this invention to be used with conventional guns employing an electrical primer.

Although the invention has been described relative to a specific embodiment thereof, there are numerous variations and modifications that will be readily apparent to those skilled in the art in the light of the above teachings. It is therefore to be understood that, within the scope of the appended claims, the invention may be practiced other than as specifically described.

What is claimed as new and desired to be secured by Letters Patent of the United States is:

1. A sliding breech block system for repetitive firing of an electrothermal gun comprising:

a high energy electrical pulse-forming network;

means for sending electrical pulses comprising a flexible, high power cable connected on its distal end to said pulse-forming network and having an inner and outer layer of multi-strand wire, each layer being separately insulated, and each layer having a proximal end with said flexible, high power cable having a jacket of braided wire encircling the outer layer of multi-strand wire with said jacket being electrically connected at each end to the outer layer of multi-strand wire;

a sliding breech block electrically connected to said means for sending; and means for conducting the electrical pulses from said sliding breech block through an electrothermal cartridge.

2. A sliding breech block system as in claim 1, wherein the flexible, high power cable further comprises a plurality of layers of fiberglass tape, the fiberglass tape being wound in a helical pattern over the jacket of braided wire.

* * * * *